US005944190A

United States Patent [19]

Edelen

[11] Patent Number: 5,944,190

[45] Date of Patent: Aug. 31, 1999

[54] RADIOPHARMACEUTICAL CAPSULE SAFE

[75] Inventor: David A. Edelen, Alton, Ill.

[73] Assignee: Mallinckrodt Inc., St. Louis, Mo.

[21] Appl. No.: 08/865,995

[22] Filed: May 30, 1997

[51] Int. Cl.[6] ..... G21F 5/015; G21F 5/04

[52] U.S. Cl. ..... 206/524.4; 250/506.1; 250/507.1

[58] Field of Search ..... 206/528, 524.4; 250/506.1, 507.1

[56] References Cited

U.S. PATENT DOCUMENTS

| | | | |
|---|---|---|---|
| D. 364,501 | 11/1995 | Gough . | |
| 2,915,640 | 12/1959 | Grubel et al. | 250/507.1 |
| 3,531,644 | 9/1970 | Koster | 2450/507.1 |
| 3,655,985 | 4/1972 | Brown et al. | 250/506.1 |
| 3,673,411 | 6/1972 | Glasser | 250/506.1 |
| 3,971,955 | 7/1976 | Heyer et al. | 250/507.1 |
| 3,993,063 | 11/1976 | Larrabee . | |
| 4,020,355 | 4/1977 | Czaplinski et al. | 250/506.1 |
| 4,062,353 | 12/1977 | Foster et al. . | |
| 4,081,688 | 3/1978 | Fries | 250/508.1 |
| 4,092,546 | 5/1978 | Larrabee . | |
| 4,122,836 | 10/1978 | Burnett . | |
| 4,144,461 | 3/1979 | Glasser et al. | 250/506.1 |
| 4,307,713 | 12/1981 | Galkin et al. . | |
| 4,382,512 | 5/1983 | Furminger | 250/506.1 |
| 4,393,864 | 7/1983 | Galkin et al. . | |
| 4,401,108 | 8/1983 | Galkin et al. . | |
| 4,453,081 | 6/1984 | Christ et al. . | |
| 4,673,813 | 6/1987 | Sanchez | 250/506.1 |
| 4,788,438 | 11/1988 | Evers | 250/506.1 |
| 4,846,235 | 7/1989 | Handke . | |
| 4,851,702 | 7/1989 | Perlman . | |
| 4,869,299 | 9/1989 | Handke . | |
| 4,923,088 | 5/1990 | Tanaka et al. . | |
| 5,042,679 | 8/1991 | Crowson et al. . | |
| 5,274,239 | 12/1993 | Lane et al. | 250/506.1 |
| 5,519,931 | 5/1996 | Reich . | |
| 5,529,189 | 6/1996 | Feldschuh . | |
| 5,536,945 | 7/1996 | Reich . | |
| 5,552,612 | 9/1996 | Katayama et al. . | |
| 5,611,429 | 3/1997 | Phillips | 206/524.4 |

FOREIGN PATENT DOCUMENTS 9525331 9/1995 WIPO .

*Primary Examiner*—David T. Fidei
*Attorney, Agent, or Firm*—Rothwell, Figg, Ernst & Kurz, p.c.

[57] ABSTRACT

A radiopharmaceutical capsule safe has a two-piece capsule vial that is sealed within a two-piece radiopaque safe which, in turn, is preferably contained within an outer jar. The cap of the two-piece vial is radiotransmissive such that the radiopharmaceutical capsule can be assayed simply by removing the lid portion of the safe from the bottom of the safe while leaving the radiopharmaceutical capsule environmentally sealed within the vial. After replacing the safe lid, the vial is opened by rotating the safe lid, which automatically turns the vial cap to disengage it from the vial bottom for dosing of the capsule to a patient.

16 Claims, 5 Drawing Sheets

RADIOPHARMACEUTICAL CAPSULE SAFE

FIELD OF THE INVENTION

The invention relates to containers for the transport and handling of radiopharmaceutical capsules, e.g., radioactive iodine capsules.

BACKGROUND OF THE INVENTION

Radiopharmaceutical capsules, e.g., radioactive iodine capsules, are used, for example, in oncology, e.g., in the treatment of thyroid cancer. Because of their radioactivity, such capsules typically are stored and transported in resealable lead canisters or "safes." Previously, such safes have been constructed so that they are either closed, i.e., the radiopharmaceutical capsules is environmentally sealed and the radiation is contained within the safe, or open, i.e., the capsule is environmentally exposed and the radiation is no longer contained. With such safe configurations, the radiopharmaceutical capsule is environmentally exposed even when the capsule is only being assayed, i.e., the radioactive strength of the capsule is being measured by means of a Geiger counter or in an ionization chamber.

SUMMARY OF THE INVENTION

The present invention provides a radiopharmaceutical capsule safe in which a radiopharmaceutical capsule can be packaged and transported. The radiopharmaceutical capsule is secured within a capsule vial, and the capsule vial, in turn, is secured in the middle of a radiopaque vessel or safe. The radiopharmaceutical capsule safe according to the invention is configured such that when it is only desired to assay the capsule, the upper portion or lid of the safe is turned in one direction and lifted away from the bottom portion of the safe, leaving the capsule vial sealed and secured within the safe bottom. When it is desired to dose the capsule, i.e., to deliver it to a patient, the safe lid is turned in the opposite direction (assuming it has been replaced after assaying) to unscrew the vial cap from the vial, thereby opening the vial and permitting access to the radiopharmaceutical capsule.

Thus, according to a first aspect of the invention, the invention provides a radiopharmaceutical capsule safe. The radiopharmaceutical capsule safe includes a safe which, in turn, includes a safe bottom and a safe lid, each of which is formed from radiopaque material such as lead. The safe bottom has a vial bottom-receiving cavity formed therein, and the safe lid has a vial cap-receiving cavity formed therein. The radiopharmaceutical capsule safe also includes a capsule vial which, in turn, includes a vial bottom and a vial cap that is securable to the vial bottom. The vial cap is formed from radiotransmissive material such as plastic, and the vial bottom is configured to receive the radiopharmaceutical capsule therein. The configuration is such that the vial bottom fits within the vial bottom-receiving cavity in the safe bottom, and the vial cap fits within the vial cap-receiving cavity in the safe lid so that the capsule vial is completely encased within the safe when the safe lid is engaged with the safe bottom. By removing the safe lid but leaving the vial cap engaged with the vial bottom, the radiopharmaceutical capsule can be assayed while environmentally sealed within the vial capsule.

Preferred embodiments of the invention may include one or more of the following features. The vial bottom can have two or more tabs extending outwardly therefrom, and the vial cap can similarly have two or more cap tabs extending outwardly therefrom. The tabs fit within slots in the vial bottom-receiving cavity and the vial cap-receiving cavity, respectively, and the vial cap can be disengaged from the vial bottom by rotating the safe lid relative to the safe bottom. The slots in the safe lid and/or the slots in the safe bottom can have circumferentially oriented tab-engaging slot extensions that permit limited rotation of the safe lid relative to the vial cap and/or limited rotation of the vial bottom relative to the safe bottom. The slot extensions retain the vial cap and the vial bottom in the respective safe lid or safe bottom. The slots and slot extensions may be provided by means of an upper and/or lower lock ring positioned in the opening of the vial cap-receiving cavity and/or the vial bottom-receiving cavity. The radiopharmaceutical capsule safe preferably includes a two-piece outer jar that consists of a jar bottom and a jar cap engageable with the jar bottom. The radiopaque safe is enclosed within the outer jar, preferably with the safe bottom retained within the jar bottom by means of a retaining member such as a retaining ring located at the open end of the jar bottom.

In another aspect, the invention provides a method of packaging a radiopharmaceutical capsule. The method includes providing a safe, which safe includes a safe bottom and a safe lid, each being formed from radiopaque material. The safe bottom and the safe lid are engageable with each other. A capsule vial including a vial bottom and a vial cap is also provided, the vial cap being formed from radiotransmissive material. The vial bottom is disposed in a vial bottom-receiving cavity formed in the safe bottom, the vial cap is disposed in a vial cap-receiving cavity formed in the safe lid, and the radiopharmaceutical capsule is disposed in the vial bottom. The vial cap is engaged to the vial bottom, and the safe lid is engaged to the safe bottom.

Preferably, the vial cap is disposed in the vial cap-receiving cavity before the vial cap is engaged with the vial bottom such that the vial cap is engaged with the vial bottom generally simultaneously with the safe lid being engaged with the safe bottom. Furthermore, activated charcoal is preferably disposed in the bottom of the vial bottom-receiving cavity before disposing the vial bottom in the bottom receiving cavity. The radiopaque safe is then preferably sealed within an outer jar that preferably is formed from plastic.

In another aspect, the invention provides a method of assaying a radiopharmaceutical capsule. The method includes providing a radiopharmaceutical capsule that is disposed in a sealed capsule vial. The capsule vial is disposed in a sealed, radiopaque safe that has a safe bottom and a safe lid. The safe lid is removed from the safe bottom to expose the vial cap, which is radiotransmissive, while leaving the vial cap engaged with the vial bottom and the vial bottom disposed within the safe bottom. The radiopharmaceutical capsule is then assayed while still sealed within the capsule vial.

In another aspect, the invention provides a method of dosing a radiopharmaceutical capsule. The method includes providing a radiopharmaceutical capsule that is disposed in a separate, sealed capsule vial. The capsule vial has a cap and a bottom and is disposed in a sealed, radiopaque safe having a radiopaque safe lid engaged with a radiopaque safe bottom. The vial cap is removed from the vial bottom, to expose the capsule for dosing, by disengaging the safe lid from the safe bottom.

Finally, in another aspect, the invention provides a method of assaying and dosing a radiopharmaceutical capsule. A radiopharmaceutical capsule is provided in a sealed vial that is disposed in a sealed, radiopaque safe. The safe lid is removed from the safe bottom to expose the cap of the vial, which is radiotransmissive, while leaving the vial sealed with the vial bottom still disposed in the safe bottom. The radiopharmaceutical capsule is then assayed while still sealed within the capsule vial, and then the safe lid is re-engaged with the safe bottom to reseal the vial within the safe. Subsequently, the vial cap is removed from the vial bottom by disengaging the safe lid from the safe bottom and the radiopharmaceutical capsule is dispensed from the vial.

BRIEF DESCRIPTION OF THE DRAWINGS

Embodiments of the invention will be described in detail in conjunction with the appended drawings, in which.

DETAILED DESCRIPTION OF PREFERRED EMBODIMENTS

Figure 1:
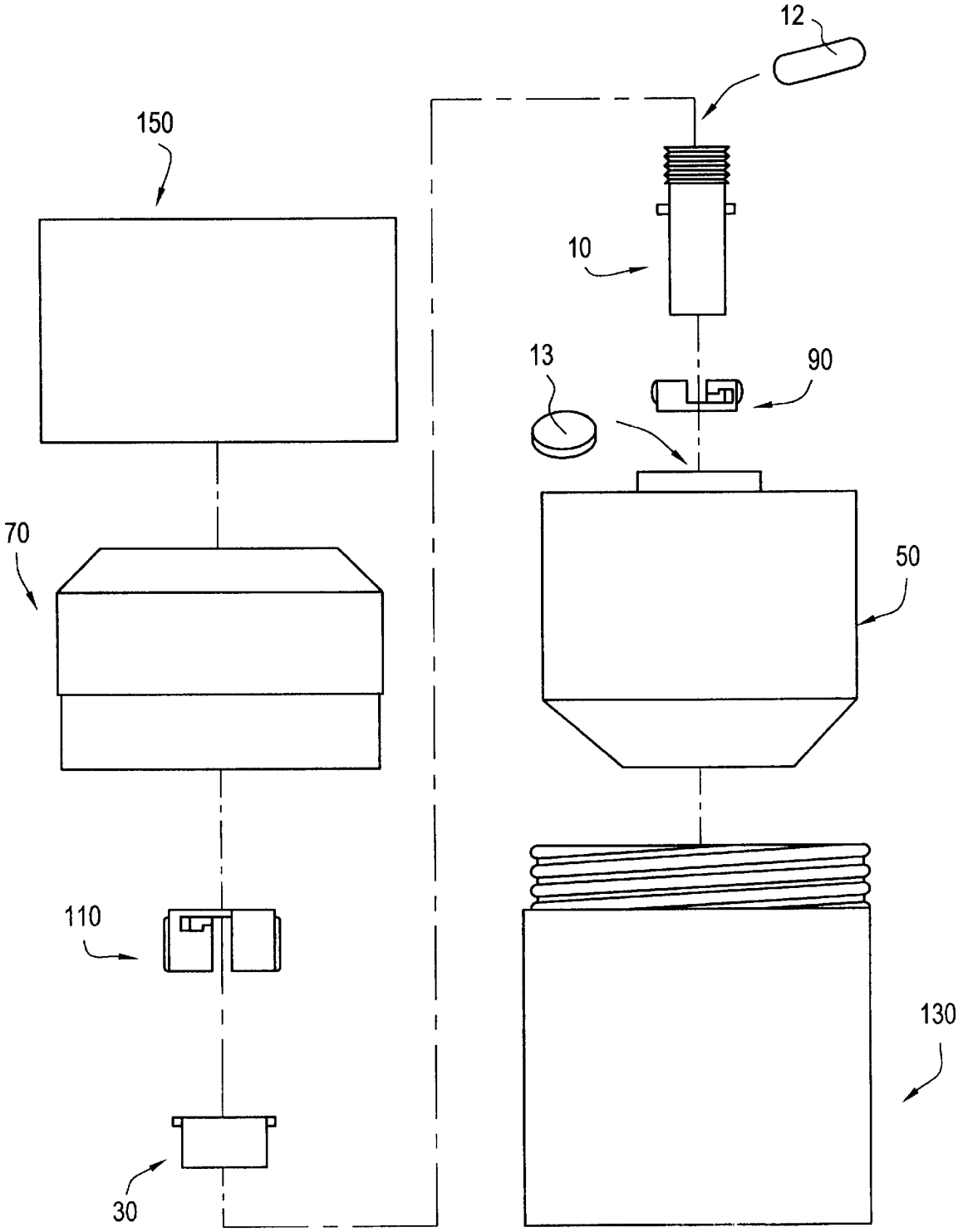
FIG. 1 is an assembly view of a radiopharmaceutical capsule safe according to the invention.
Figure 2B:
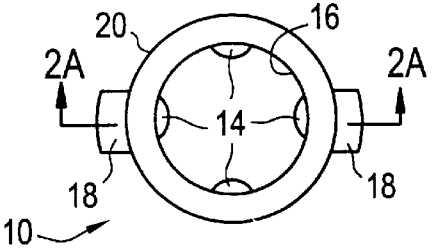
FIGS. 2A and 2B are, respectively, a section view (taken along lines 2A—2A in FIG. 2B) and a top view of the radiopharmaceutical capsule vial shown in FIG. 1.
Figure 2A:
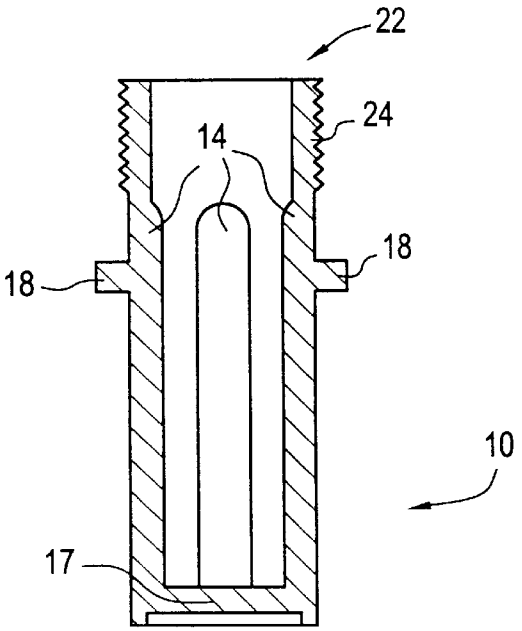

A preferred embodiment of a radiopharmaceutical capsule safe according to the invention is shown in "exploded" or assembly form in FIG. 1. The radiopharmaceutical capsule safe includes a vial 10 in which a radiopharmaceutical capsule 12 is contained. As shown in greater detail in FIGS. 2A and 2B, the vial 10 is generally cylindrical and is made from plastic such as acrylic. A plurality of centering lands 14, e.g., four, protrude from the cylindrical inner wall 16 of the vial and extend longitudinally from the closed bottom end 17 of the vial substantially along the length of the vial. The centering lands 14 are evenly spaced circumferentially and center the radiopharmaceutical capsule 12 within the vial 10. The vial has two or more vial tabs 18 extending from the outer cylindrical surface 20 thereof. The vial tabs 18 preferably are evenly spaced circumferentially.

Figure 3A:
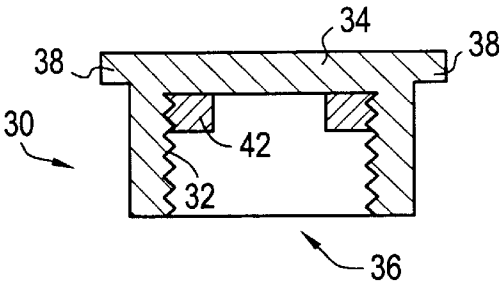
FIGS. 3A and 3B are, respectively, a section view (taken along lines 3A—3A in FIG. 3B) and a bottom view of the radiopharmaceutical vial cap shown in FIG. 1.
Figure 3B:
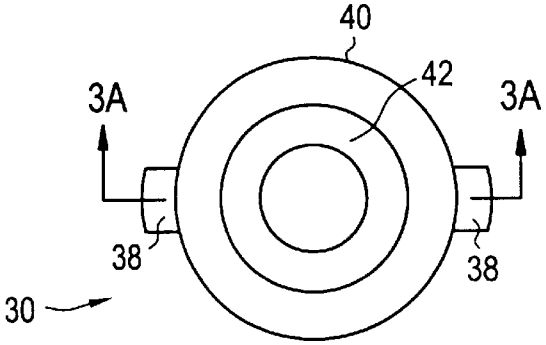

The open upper end 22 of the vial has external threads 24. External threads 24 mate with internal threads 32 of vial cap 30 (FIGS. 3A and 3B). The vial cap is generally cylindrical and has a closed upper end 34 and an open lower end 36. It, too, is made from plastic or other radiotransmissive material such as acrylic. Like the vial 10, the vial cap 30 has two or more cap tabs 38 protruding from the cylindrical outer surface 40 thereof. The cap tabs 38 preferably are evenly spaced circumferentially. A neoprene gasket 42 is situated against the closed upper end 34 of the vial cap and ensures an airtight seal when the vial cap is screwed onto the vial 10, in an assembly procedure which will be described below.

Figure 4B:
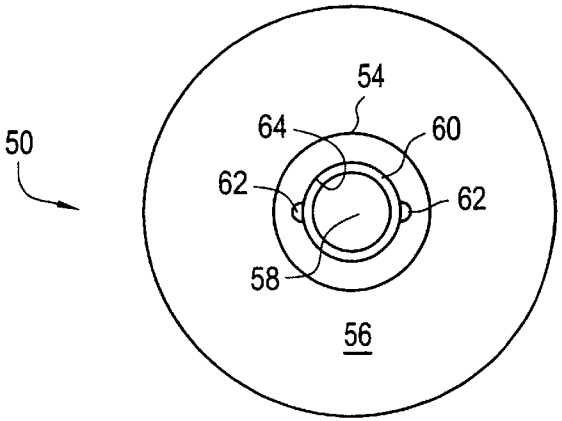
FIGS. 4A and 4B are a side elevation view and a top view, respectively, of the safe bottom shown in FIG. 1.
Figure 4A:
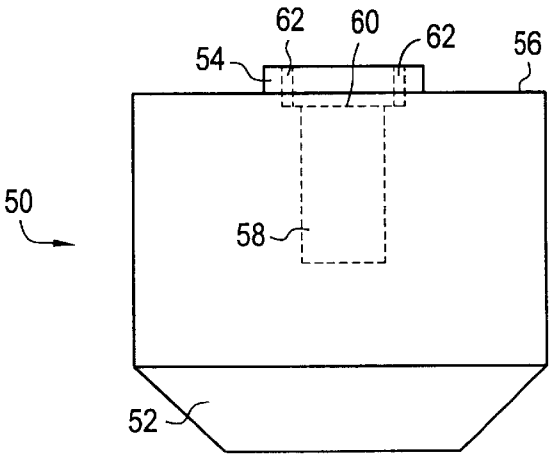

When closed, the vial is secured within a radiopaque safe which is comprised of a safe bottom 50 and a safe lid 70. As shown in greater detail in FIGS. 4A and 4E, the safe bottom 50 is a generally solid, cylindrical mass of lead (97% lead/3% antimony alloy) with a tapered or frustroconical lower portion 52. A boss 54 extends from the center of the upper surface 56 of the safe bottom. Vial-receiving cavity 58 is formed as a counterbore extending through the center of the boss 54 and approximately half-way through the axial length of the safe bottom. The counterbore configuration provides the vial-receiving cavity 58 with an annular shoulder 60. Two or more longitudinally extending semicircular grooves 62 are formed in the cylindrical surface 64 of the counterbore portion of the vial-receiving cavity 58.

Figure 5A:
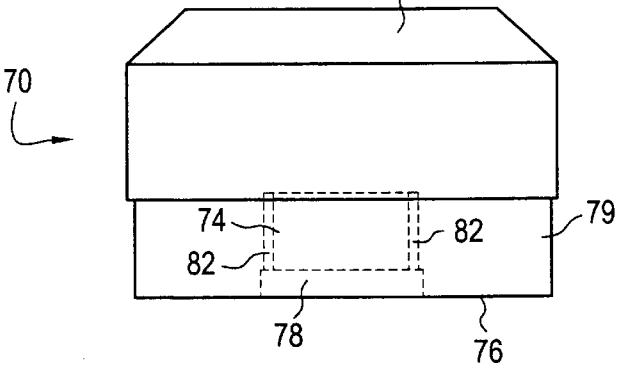
FIGS. 5A and 5B are a side elevation view and a bottom view, respectively, of the safe lid shown in FIG. 1.
Figure 5B:
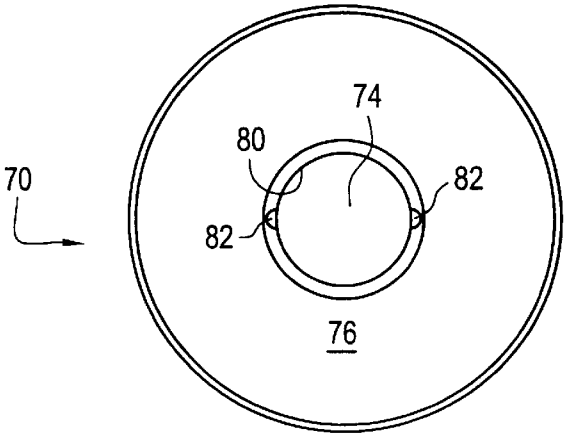
Figure 7A:
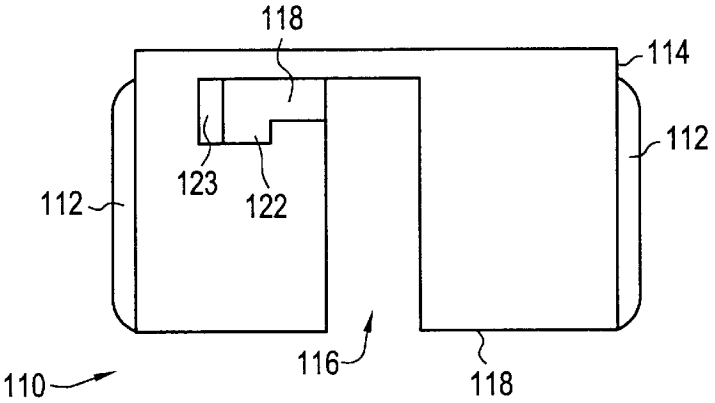
FIGS. 7A and 7B are a side elevation view and a bottom view, respectively, of the upper lock ring shown in FIG. 1.
Figure 7B:
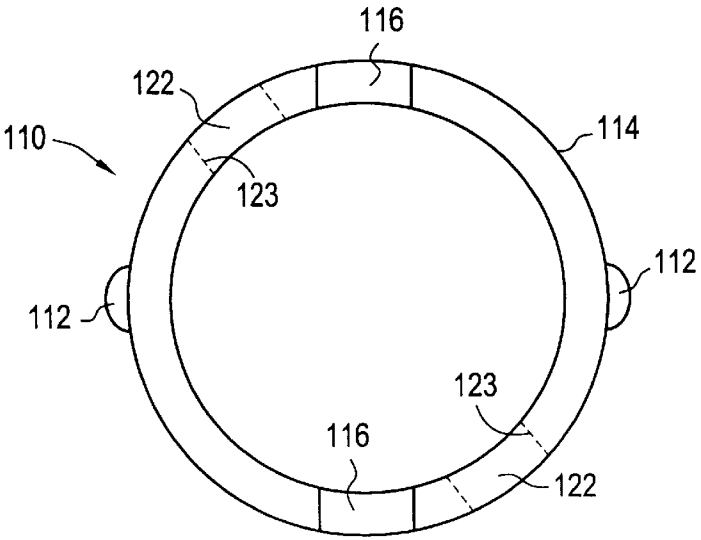
Figure 8:
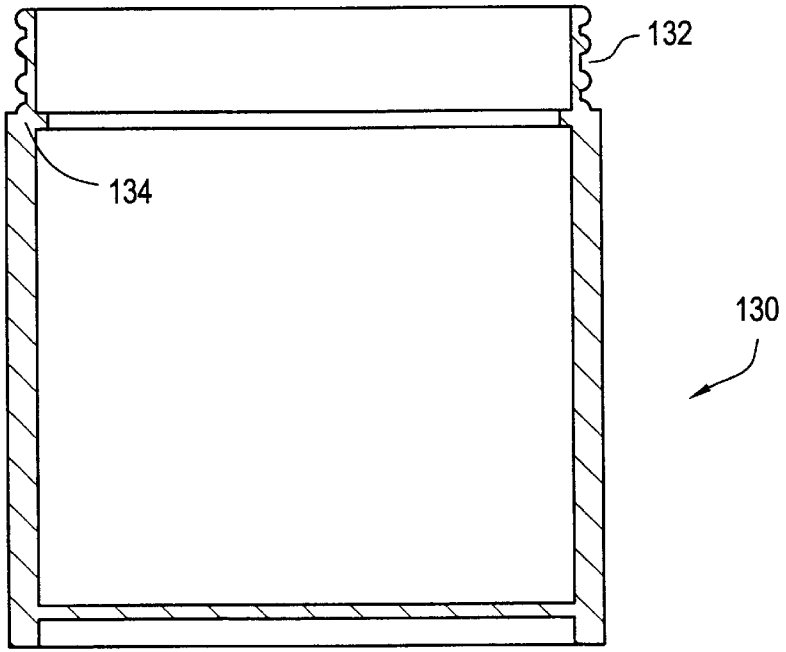
FIGS. 8 and 9 are section views of the jar bottom and jar lid, respectively, shown in FIG. 1.

As shown in FIGS. 5A and 5B, the safe lid 70 is generally similarly shaped. Specifically, it is a generally solid, cylindrical mass of lead (97% lead/3% antimony alloy) with a tapered or frustroconical upper portion 72. Vial cap-receiving cavity 74 is formed as a counterbore which extends from the bottom surface 76 of the safe lid approximately half-way into the interior of the safe lid. The counterbore portion 78 of the vial cap-receiving cavity has a diameter and a depth that are substantially the same as the diameter and height, respectively, of the boss 54 extending from the upper surface 56 of the safe bottom. This permits the safe bottom and the safe lid to be positioned together with the boss extending into the counterbore portion 78 of the vial cap-receiving cavity 74 and with the surfaces 56 and 76 mating flush. The cylindrical surface 80 of the vial cap-receiving cavity 74 also has two or more longitudinally extending semicircular grooves 82 formed therein.

The radiopharmaceutical capsule safe utilizes a lower and an upper lock ring 90 and 110, respectively (FIGS. 6A, 6B, 7A, and 7B). The lower and upper lock rings have generally similar construction. Both are formed from plastic such as acrylic and have two or more semicircular ridges 92, 112 extending longitudinally along their outer cylindrical surfaces 94, 114, respectively. The outer diameter of the lower lock ring is generally the same as the diameter of the counterbore portion of the vial-receiving cavity 58 in the safe bottom 50, and the inner diameter of the lower lock ring is substantially the same as the outer diameter of the vial 10. Similarly, the outer diameter of the upper lock ring is substantially the same as the diameter of the counterbore portion of the vial cap-receiving cavity 74 in the safe lid, and the inner diameter of the upper lock ring is substantially the same as the outer diameter of the vial cap 30.

Figure 6B:
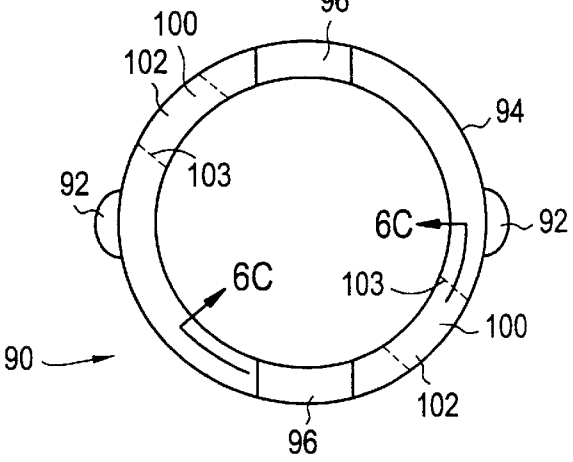
FIGS. 6A and 6B are a side elevation view and a top view, respectively, of the lower lock ring shown in FIG. 1.
Figure 6A:
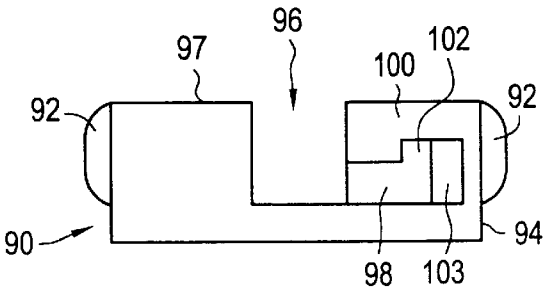
Figure 6C:
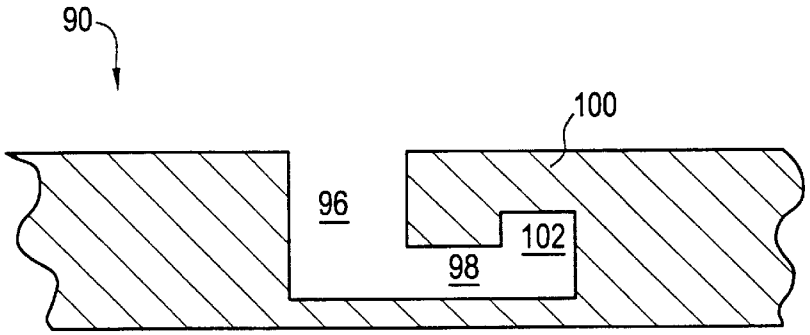
FIG. 6C is a section view taken along lines 6C—6C in FIG. 6B.
Figure 9:
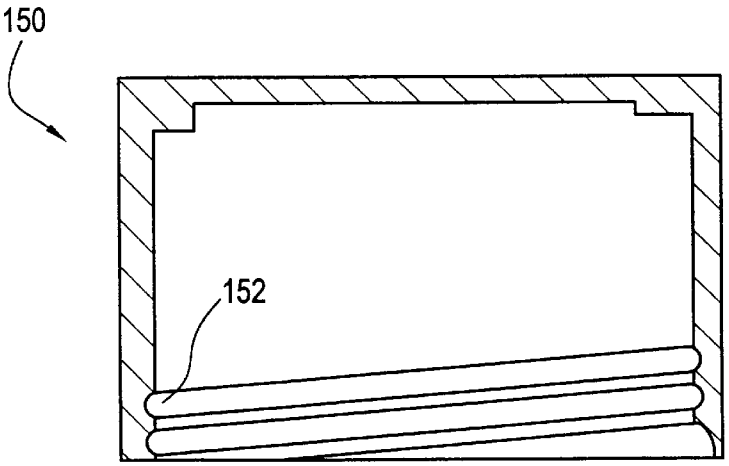

The lower lock ring 90 has a pair of diametrically opposed tab-receiving slots 96 which extend from the upper surface 97 of the ring toward the bottom of the ring. Tab-engaging slot extensions 98 extend circumferentially from the bottom of each of the tab-receiving slots 96 such that a cantilevered overhanging portion 100 is formed, with a slight undercut portion 102 indicated by the dashed lines in FIG. 6B. (One of the dashed lines of each pair represents the end wall 103 of each slot extension.) The configuration, which is shown in more detail in FIG. 6C, permits the tabs 18 extending from the outer surface of the vial 10 to slide down into the tab-receiving slots 96 and then to rotate counterclockwise as seen from above (i.e., to the right as shown in FIG. 6C) under the overhanging portion 100.

Similarly, the upper lock ring 110 has diametrically opposed tab-receiving slots 116 extending from the bottom of the ring 118 substantially toward the top of the ring, and tab-engaging slot extensions 118 extending circumferentially a short distance from the tops of the tab-receiving slots 116. The tab-engaging slot extensions 118 have undercut portions 122, which are indicated by the dashed lines in FIG. 7B. (One of the dashed lines of each pair represents the end wall 123 of each slot extension.) Thus, the configuration of the upper lock ring is such that the tabs 38 extending from the outer surface of the vial cap slide up into the tab-receiving slots 116 and then can rotate clockwise (as seen from above) into the tab-engaging slot extensions 118.

The radiopharmaceutical capsule safe is contained within an outer jar consisting of a jar bottom 130 made from plastic, such as polypropylene, and a mating jar lid 150, also made from plastic such as polypropylene. The jar bottom 130 is generally an open-topped cylindrical vessel with external threads at the open end thereof. The jar bottom has an annular rib 134 extending along the circumference of the jar bottom and located near the open end of the jar bottom. The jar lid 150 is similarly an open-bottomed cylindrical cap, with internal threads 152 that mate with the external threads 132 of the jar bottom 130.

The radiopharmaceutical capsule safe of the invention is used as follows. When packaging the radiopharmaceutical capsule, the safe bottom 50 is inserted into the jar 130, as shown in FIG. 1. The safe bottom 50 is pressed past the annular rib 134 at the open end of the jar 130, and then the rib 134 snaps back to retain the safe bottom in the jar. The lower lock ring 90 is then press fit into the counterbore portion of the vial-receiving cavity 58, with the ridges 92 protruding from the locking ring fitting into the grooves 62 formed in the cylindrical surface 64 of the counterbore portion.

An activated charcoal insert 13 is placed in the bottom of the vial bottom-receiving cavity to trap airborne iodine particles, and the vial 10 is inserted down into the vial bottom-receiving cavity 58 with the tabs 18 extending from the vial sliding down into the tab-receiving slots 96 in the lower lock ring 90.

Similarly, the upper lock ring 110 is press fit into the counterbore portion of the cap-receiving cavity 74 in the safe lid, with the ridges 112 protruding from the upper lock ring fitting within the grooves 82 formed in the cylindrical wall surface of the cap-receiving cavity 74. It may be desirable to apply a small amount of adhesive to the outer surface of the upper lock ring to help secure it in place. The vial cap 30 is then inserted into the safe lid by sliding the tabs 38 extending therefrom along the tab-receiving slots 116 in the upper lock ring 110 and then rotating the vial cap such that the tabs 38 slide into the tab-engaging slot extensions 118.

The radiopharmaceutical capsule 12 is then placed in the vial 10, and the safe lid/vial cap assembly is placed over the vial and rotated in a clockwise direction (as seen from above) to screw the vial cap 30 down onto the vial 10. (The lower portion 79 of the safe lid is the same diameter as the inside diameter of the rib 134 at the open end of the jar 130 such that the safe lid rests flush against the safe bottom.) Finally, the jar cap 150 is screwed onto the jar 130 to complete the package.

When assaying of the radiopharmaceutical capsule is required, the plastic jar cap is unscrewed to expose the safe lid. The safe lid can be pulled straight off the vial cap if the tabs 38 are aligned with the tab-receiving slots 116 in the upper lock ring; otherwise, if the tabs 38 are positioned in the tab-engaging slot extensions 118, the safe lid is rotated clockwise a slight amount, until the tabs are felt to abut the opposite side-walls of the tab-receiving slots 116, and then the safe lid/upper lock ring assembly is lifted to expose the vial cap 30. At this point, because the vial cap 30 is made from plastic and is transmissive of radiation emitted by the radiopharmaceutical capsule, the capsule can be assayed without opening the vial itself. Because the radiopharmaceutical capsule typically is not dosed to a patient until some time later, the safe lid/upper lock ring assembly typically is then replaced over the vial cap 30.

When it is ultimately desired to dose the radiopharmaceutical capsule to a patient, the safe lid is turned counterclockwise, as seen from above. As this is done, the tab-engaging slot extensions 118 in the upper lock ring will rotate into position over the tabs 38 extending from the vial cap 30, and then the vial 10 will be rotated such that the tabs 18 extending therefrom will rotate into position in the tab-engaging slot extensions 98 in the lower lock ring 90 (if they were not located there already). As the safe lid continues to be rotated, the vial cap 30 is unscrewed from the vial 10 and can be lifted away from the vial. Because the vial cap 30 is caused to rotate by means of the end walls 123 of the tab-receiving slot extensions 118 bearing against the tabs 38 as the safe lid is rotated counterclockwise, the tabs 38 will be positioned over the undercuts 122 as the vial cap 30 is lifted away from the vial 10. Thus, when the vial cap is disengaged from the vial and lifted away from it, the tabs will be retained in the undercuts 122 such that the vial cap is held securely in the safe lid. Similarly, because the vial is restrained from rotating (such that the vial cap can be unscrewed from it) by means of the tabs 18 extending therefrom butting up against the end walls 103 of the tab-engaging slot extensions 98 in the lower lock ring, the tabs 18 will be positioned under the undercuts 102 when the vial cap is removed from the vial. Thus, the radiopharmaceutical capsule can be poured out of the vial by turning the safe bottom over, but the vial will be retained in the safe bottom by means of the undercuts 102.

It will be appreciated that the above-described embodiment is exemplary only and that modifications thereto will occur to those having skill in the art. For example, the upper and lower lock rings 110 and 90 may be foregone if appropriately shaped slots and slot extensions are formed in the counterbore portions of the cap-receiving and vial-receiving cavities, respectively. The tab/slot arrangement may even be reversed such that the tabs protrude from the walls of the vial bottom-receiving and vial cap-receiving cavities and the vial bottom and vial cap are grooved. Additionally, the number of ridges 92 and/or 112, and accordingly the number of positioning grooves 62 and/or 82, may be varied. The number of tabs 18 and/or 38 may be varied, as long as the number of tab-receiving and tab-engaging slots is varied accordingly. Other embodiments are deemed to be within the scope of the following claims.

What is claimed:

1. A radiopharmaceutical capsule safe, comprising:

a safe comprising a safe bottom and a safe lid, said safe bottom and said safe lid each being formed from radiopaque material, said safe bottom having a vial bottom-receiving cavity formed therein and said safe lid having a vial cap-receiving cavity formed therein; and a capsule vial comprising a vial bottom and a vial cap securable to said vial bottom, said vial cap being formed from radiotransmissive material and said vial bottom being configured to receive a radiopharmaceutical capsule therein;

wherein said vial bottom-receiving cavity and said vial bottom are cooperatively configured such that said vial bottom is receivable within said vial bottom-receiving cavity and wherein said vial cap-receiving cavity and said vial cap are cooperatively configured such that said vial cap is receivable within said vial cap-receiving cavity;

whereby said capsule vial can be encased completely within said safe to contain radiation emitted by said radiopharmaceutical capsule when said safe lid is engaged with said safe bottom, and whereby said radiopharmaceutical capsule can be assayed while environmentally sealed within said vial capsule by removing said safe lid from engagement with said safe bottom;

wherein both the vial cap and the vial bottom are releasably lock-engageable respectively with said safe bottom and said safe wherein said vial bottom has two or more bottom tabs extending outwardly therefrom, said vial cap has two or more cap tabs extending outwardly therefrom, and said vial cap and said vial bottom are threadably engageable with each other; and wherein said safe bottom has two or more lower slots extending along the vial bottom-receiving cavity to receive the bottom tabs and said safe lid has two or more upper slots extending along the vial cap-receiving cavity to receive the cap tabs;

whereby said vial cap can be disengaged from said vial bottom by rotating said safe lid relative to said safe bottom.

2. The radiopharmaceutical capsule safe of claim 1, wherein the upper slots have circumferentially oriented upper tab-engaging slot extensions which permit limited rotation of said safe lid relative to said vial cap.

3. The radiopharmaceutical capsule safe of claim 2, wherein said upper tab-engaging slot extensions are oriented such that the cap tabs are positioned within said upper tab-engaging slot extensions when said safe lid is rotated to disengage said vial cap from said vial bottom, whereby said vial cap is retained within said vial cap-receiving cavity when disengaged from said vial bottom.

4. The radiopharmaceutical capsule safe of claim 1, wherein the lower slots have circumferentially oriented lower tab-engaging slot extensions which permit limited rotation of said vial bottom relative to said safe bottom.

5. The radiopharmaceutical capsule safe of claim 4, wherein said lower tab-engaging slot extensions are oriented such that the bottom tabs are positioned within said lower tab-engaging slot extensions when said safe lid is rotated to disengage said vial cap from said vial bottom, whereby said vial bottom is retained within said vial bottom-receiving cavity when said safe bottom is inverted to dispense a radiopharmaceutical capsule contained within said vial bottom.

6. The radiopharmaceutical capsule safe of claim 1, further comprising an upper lock ring positioned in a lower portion of said vial cap-receiving cavity, and wherein said upper slots are formed in said upper lock ring.

7. The radiopharmaceutical capsule safe of claim 1, further comprising a lower lock ring positioned in an upper portion of said vial bottom-receiving cavity, and wherein said lower slots are formed in said lower lock ring.

8. The radiopharmaceutical capsule safe of claim 2, further comprising an upper lock ring positioned in a lower portion of said vial cap-receiving cavity, and wherein said upper slots and said upper tab-engaging slot extensions are formed in said upper lock ring.

9. The radiopharmaceutical capsule safe of claim 1, further comprising a lower lock ring positioned in an upper portion of said vial bottom-receiving cavity, and wherein said lower slots and said lower tab-engaging slot extensions are formed in said lower lock ring.

10. The radiopharmaceutical capsule safe of claim 1, further comprising an outer jar in which said safe is received, said outer jar comprising a jar bottom in which said safe bottom is received and a jar cap engageable with said jar bottom and configured to cover said safe lid.

11. The radiopharmaceutical capsule safe of claim 10, wherein said jar bottom has a retaining member which retains said safe bottom within said jar bottom.

12. The radiopharmaceutical capsule safe of claim 11, wherein said retaining member comprises an annular retaining ring disposed near an upper, open portion of said jar bottom.

13. A method of packaging a radiopharmaceutical capsule, said method comprising the steps:

providing a safe comprising a safe bottom and a safe lid, each being formed from radiopague material, said safe bottom and said safe lid being engageable with each other;

providing a capsule vial comprising a vial bottom and a vial cap, said vial cap being formed from radiotransmissive material and being engageable with said vial bottom wherein at least one of the vial cap and the vial bottom is releasably lock-engageable respectively with said safe bottom and said safe lid;

disposing said vial bottom in a vial bottom-receiving cavity formed in said safe bottom;

disposing said vial cap in a vial cap-receiving cavity formed in said safe lid;

disposing a radiopharmaceutical capsule in said vial bottom;

engaging said vial cap to said vial bottom; and engaging said safe lid to said safe bottom; and further comprising disposing activated charcoal in said vial bottom-receiving cavity before disposing said vial bottom in said vial bottom-receiving cavity.

14. The method of claim 13, wherein said vial cap is disposed in said vial cap-receiving cavity before said vial cap is engaged with said vial bottom, whereby said vial cap is engaged with said vial bottom generally simultaneously with said safe lid being engaged with said safe bottom.

15. The method of claim 13, further comprising providing a jar comprising a jar bottom and a jar cap, disposing said safe bottom in said jar bottom, and securing said jar cap to said jar bottom over said safe lid.

16. The method of claim 12 wherein both the vial cap and the vial bottom are releasably lock-engageable respectively with said safe bottom and said safe lid.

* * * * *